US011691155B2

(12) United States Patent
Pitchumani et al.

(10) Patent No.: US 11,691,155 B2
(45) Date of Patent: Jul. 4, 2023

(54) METHODS AND APPARATUS FOR PRODUCING NANOMETER SCALE PARTICLES UTILIZING AN ELECTROSTERICALLY STABILIZED SLURRY IN A MEDIA MILL

(71) Applicant: U.S. SILICA COMPANY, Katy, TX (US)

(72) Inventors: Ramanan Pitchumani, Hagerstown, MD (US); William Wells, Hancock, MD (US); David Earl Weller, Jr., Greencastle, MD (US)

(73) Assignee: U.S. Silica Company, Katy, TX (US)

( * ) Notice: Subject to any disclaimer, the term of this patent is extended or adjusted under 35 U.S.C. 154(b) by 210 days.

(21) Appl. No.: 17/023,531

(22) Filed: Sep. 17, 2020

(65) Prior Publication Data

US 2022/0080429 A1 Mar. 17, 2022

(51) Int. Cl.

| | |
|---|---|
| ***B02C 17/16*** | (2006.01) |
| ***B02C 17/04*** | (2006.01) |
| ***B02C 17/18*** | (2006.01) |
| *B02C 23/36* | (2006.01) |

(52) U.S. Cl.

CPC ..... *B02C 17/16* (2013.01); *B02C 17/04* (2013.01); *B02C 17/186* (2013.01); *B02C 23/36* (2013.01)

(58) Field of Classification Search

CPC ..... B02C 17/16; B02C 17/04; B02C 17/186; B02C 23/36; B02C 23/18; B02C 23/06

See application file for complete search history.

(56) References Cited

U.S. PATENT DOCUMENTS

| | | | | |
|---|---|---|---|---|
| 5,312,055 | A | 5/1994 | Barthelmess et al. | |
| 5,513,803 | A * | 5/1996 | Czekai | B02C 17/161 977/773 |
| 5,556,038 | A | 9/1996 | Nakamura et al. | |
| 5,624,604 | A | 4/1997 | Yasrebi et al. | |

(Continued)

OTHER PUBLICATIONS

Ohenoja, K. "Particle Size Distribution and Suspension Stability in Aqueous Submicron Grinding of CaC03 and Ti02", Dissertation ACTA Universitatis Ouluensis, Jan. 10, 2014, Retrieved from the Internet: URL:http://jultika.oulu.fi/files/isbn97895 26205502.pdf.

(Continued)

*Primary Examiner* — Faye Francis

(74) *Attorney, Agent, or Firm* — The Webb Law Firm

(57) ABSTRACT

Disclosed herein are methods and apparatus for producing nanometer scale particles utilizing an electrosterically stabilized slurry in a media mill. A method for producing nanometer scale particles includes adding to a media mill a feed substrate suspension. The feed substrate suspension includes a liquid carrier medium and feed substrate particles. The method further includes adding to the feed substrate suspension in the media mill an electrosteric dispersant. The electrosteric dispersant includes a polyelectrolyte. Still further, the method includes operating the media mill for a period of time to comminute the feed substrate particles, thereby forming nanometer scale particles having a ($D_{90}$) particle size of less than about one micron, and recirculating for further grinding the nanometer scale particles from the media mill.

21 Claims, 7 Drawing Sheets

(56) References Cited

U.S. PATENT DOCUMENTS 5,662,279 A * 9/1997 Czekai ..... B02C 17/161 977/773
5,695,130 A * 12/1997 Csendes ..... B02C 23/34 241/24.31
5,826,807 A * 10/1998 Csendes ..... B02C 23/34 241/79.3
5,902,711 A 5/1999 Smith et al.
6,010,085 A 1/2000 Angeletakis
6,193,844 B1 * 2/2001 McLaughlin ..... D21H 21/52 162/175
7,014,134 B2 3/2006 Heinzelmann et al.
7,896,267 B2 3/2011 Ishigaki et al.
2004/0251329 A1 * 12/2004 Hsu ..... C09D 17/001 241/15
2005/0199556 A1 9/2005 Zhang
2008/0021147 A1 1/2008 Lin
2008/0197218 A1 8/2008 Ishigaki et al.
2008/0245912 A1 * 10/2008 Boulanger ..... C04B 35/6261 29/899
2009/0084874 A1 4/2009 Alam et al.
2011/0165421 A1 7/2011 Schlesinger et al.
2013/0264406 A1 10/2013 Morioka et al.
2014/0001294 A1 1/2014 Allen
2015/0096467 A1 * 4/2015 Trivedi ..... C04B 35/6263 106/270
2016/0016176 A1 * 1/2016 Melick ..... B02C 17/20 241/21

OTHER PUBLICATIONS

Verhiest Ket, et al. "Formulation and preparation of low-concentrated ylliia colloidal dispersions", Ceramics International, Nov. 22, 2011, pp. 2701-2709, vol. 38, No. 4.

* cited by examiner

Electrostatic Stabilization

Steric Stabilization

METHODS AND APPARATUS FOR PRODUCING NANOMETER SCALE PARTICLES UTILIZING AN ELECTROSTERICALLY STABILIZED SLURRY IN A MEDIA MILL

TECHNICAL FIELD

The present disclosure generally relates to methods and apparatus for producing ultra-fine particles for a variety of industrial and commercial purposes. More particularly, the present disclosure relates to methods and apparatus for producing nanometer scale particles utilizing an electrosterically stabilized slurry in a media mill, such as ball mills, planetary mills, conical mills, and stirred media mills.

BACKGROUND

Media milling generally refers to a process by which particles of media of a relatively larger size are broken-down into a relatively smaller size through the application of mechanical work. Conventional milling methods include dry milling and wet milling. In dry milling, air (or an inert gas) is used to keep particles in suspension while the mechanical work is applied to the particles. As the particle size decreases, however, fine particles tend to agglomerate in response to van der Waals forces, which limits the capabilities of dry milling. Wet milling, in contrast, uses a liquid such as water or organic solvents such as alcohols, aldehydes, and ketones to control re-agglomeration of fine particles. As such, wet milling is typically used for comminution of submicron-sized particles. Another process to make submicron particles is jet milling. This is a dry process that uses supersonic air or steam. However, it is very expensive as it is highly energy intensive.

In conventional practice, a wet mill typically includes a milling media which, when subjected to mechanical work such as stirring or agitation, applies sufficient force to break particles that are suspended in a liquid medium. Milling devices are categorized by the method used to impart the mechanical work to the media. The works imparted in wet mills may include stirring, tumbling, vibratory motion, planetary motion, agitation, and ultrasonic milling, among others.

Of the foregoing mill types, the stirred media mill, which utilizes balls of various sizes as its milling media and stirring as its method for applying mechanical work, has several advantages for particle comminution including high energy efficiency, high solids handling, narrow size distribution of the product output, and the ability to produce homogeneous slurries. Variables that may be considered in using a stirred media mill include, for example, agitator speed, suspension flow rate, residence time, slurry viscosity and concentration, solid size of the in-feed particles, milling media (i.e., ball) size, media fill rate (i.e., the amount of beads in the mill chamber, and desired product size.

Despite these advantages, however, stirred media mills suffer from several drawbacks as the desired product particle size decreases below about 1 micron and especially below about 500 nanometers. For example, in the sub-micron particle size range, the behavior of the product suspension (slurry) is increasingly influenced by particle-particle interactions. Due to these interactions, spontaneous agglomeration of particles may occur, and the viscosity of the product suspension increases. When product particle sizes are below about 1 micron, these interactions may lead to an equilibrium state between agglomeration, deagglomeration, and comminution, resulting in no further comminution progress even with an increasing energy input. Moreover, particle agglomeration, along with an increase in viscosity of the product suspension, which increases the required power consumption due to a high load on the motor mill, may cause a blockage of the media mill screen and no further flow of the suspension, preventing any particles from exiting the mill as product.

Various methods have been attempted to inhibit these re-agglomeration effects. For example, electrostatic stabilization methods have been used to maintain particle separation during milling. As illustrated in FIG. 1, electrostatic stabilization involves creating like charges on the surface of colloidal particles so that the particles repel each other, thereby dispersing the suspension of the particles. Electrostatic stabilization methods may be performed by adjusting the pH of the product suspension. Adjustment of pH may be controlled by the addition of either acids or bases, including weak and strong acids as well as weak and strong bases. Electrostatic stabilization methods may alternatively be performed by adding anionic or cationic dispersing agents to the product suspension. These dispersants electrostatically stabilize the product suspension by adding a positive or negative charge to the particles when the dispersant is adsorbed on the surface of the particles.

These electrostatic methods suffer from several drawbacks, however, making them difficult to implement in industrial-scale manufacturing. Particularly, using electrostatic methods, constant monitoring and adjustment of the process is required, due to the fact that as the particle sizes decrease, their surface area increases, and any acid/base or dispersant added becomes less effective. As the specific surface area of the particles increase exponentially and the particle size decreases, greater and greater amounts of acid, alkali, or dispersants are required, and if the amount thereof deviates even slightly from the required amount, the entire suspension is susceptible to flocculation, and no more milling would be possible due to a sharp increase in viscosity and blockage of the mill screen.

In other examples, steric stabilization methods have been used to maintain particle separation during milling. Steric stabilization methods utilize nonionic or electroneutral dispersants to separate the particles in suspension. As illustrated in FIG. 2, steric stabilization involves adsorbing relatively long chain polymeric compounds onto the surface of the particles. Parts of the polymer become strongly attached to the surface of particles, whereas the rest of the polymer may trail freely in the liquid medium of the suspension. If the liquid medium is a good solvent for the polymer, inter-penetration of polymer chains, i.e., the interaction of polymers on separate particles, is not energetically favorable. As a result, individual particles repel each other (inter-particle repulsion), thereby dispersing the suspension.

Like the electrostatic methods, however, these steric methods suffer from several drawbacks, making them difficult to implement in industrial-scale manufacturing. For example, steric stabilizing dispersants have the disadvantage that large quantities of dispersants are required as smaller and smaller particle sizes are generated. During milling, the surface area of the particles increases exponentially, and adsorption of these the dispersants on the surface of the particles reduces, making the milling process difficult to control.

Accordingly, it would be desirable to provide improved methods for producing particles in the sub-micron range using wet milling processes. The wet milling processes would beneficially maintain particle separation as the particle size decrease below 1 micron to avoid agglomeration and mill screen blockage. Moreover, the wet milling processes would beneficially be suitable for industrial-scale manufacturing to the extent that extremely tight control of any additives would not be required to prevent product suspension flocculation or steep increases in viscosity. Furthermore, other desirable features and characteristics of the vibration isolator assemblies will become apparent from the subsequent detailed description and the appended claims, taken in conjunction with the accompanying drawings and the preceding background.

BRIEF SUMMARY

Disclosed herein are methods and apparatus for producing nanometer scale particles utilizing an electrosterically stabilized slurry in a media mill. In accordance with one embodiment, a method for producing nanometer scale particles includes adding to a media mill a feed substrate suspension. The feed substrate suspension includes a liquid carrier medium and feed substrate particles. The method further includes adding to the feed substrate suspension in the media mill an electrosteric dispersant. The electrosteric dispersant includes a polyelectrolyte, various examples of which are listed in greater detail below. Still further, the method includes operating the media mill for a period of time to comminute the feed substrate particles, thereby forming nanometer scale particles having a ($D_{90}$) particle size of less than about one micron, and recirculating for further grinding the nanometer scale particles from the media mill.

In accordance with another embodiment, a media mill apparatus configured for producing nanometer scale particles includes a milling chamber, an agitator extending into the milling chamber, a milling media disposed within the milling chamber, and a feed substrate suspension including a liquid carrier medium and feed substrate particles, and disposed within the milling chamber and interspersed with the milling media. The media mill apparatus further includes an electrosteric dispersant including a polyelectrolyte mixed within the feed substrate suspension. The agitator is configured to apply mechanical work to the milling media for a period of time, thereby causing the milling media to comminute the feed substrate particles to form nanometer scale particles having a ($D_{90}$) particle size of less than about one micron.

In accordance with yet another embodiment, a method is provided for producing nanometer scale particles in a media mill including a milling media, wherein the method includes adding to the media mill a feed substrate suspension. The feed substrate suspension includes a liquid carrier medium including water or an organic solvent and feed substrate particles including any solid material that needs to be ground to small sizes, such as organic and inorganic solids, glass, graphene, metals, minerals, ores, silica, diatomaceous earth, clays, organic and inorganic pigments, pharmaceutical materials, or carbon black. The feed substrate particles are present in the feed substrate suspension in an amount of about 5% to about 70% by weight of the feed substrate suspension, or from about 5% to about 40% by weight. The method further includes adding to the feed substrate suspension in the media mill an electrosteric dispersant. The electrosteric dispersant includes a polyelectrolyte. The polyelectrolyte includes a polymer or copolymer having electrically-charged functional groups or inorganic affinic groups. The electrosteric dispersant is added in an amount of about 2% to about 20% by weight of the feed substrate particles. The method further includes operating the media mill for a period of time of about 10 minutes to about 6,000 minutes to comminute the feed substrate particles, thereby forming nanometer scale particles having a ($D_{90}$) particle size of less than about one micron, recirculating for further grinding the nanometer scale particles from the media mill, and separating the nanometer scale particles from the milling media. Still further, the method includes drying the nanometers scale particles after separating the nanometer scale particles from the milling media.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

BRIEF DESCRIPTION OF THE DRAWING

The present disclosure will hereinafter be described in conjunction with the following drawing figures, wherein like numerals denote like elements, and wherein.

DETAILED DESCRIPTION

Figure 1:
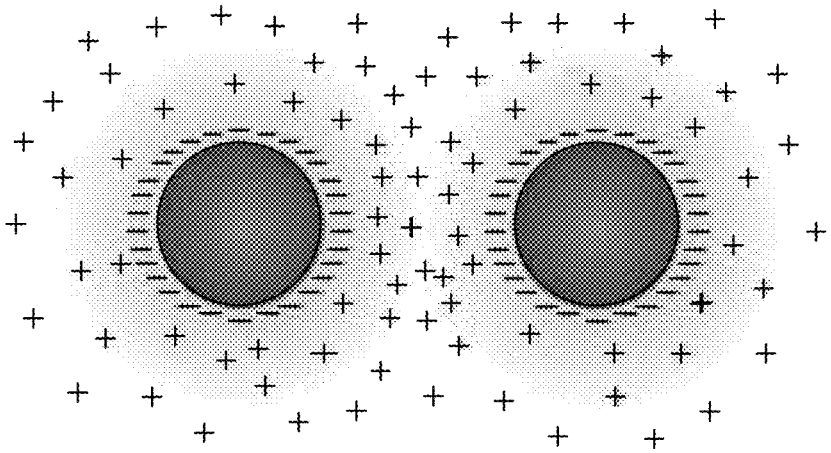
FIG. 1 (Prior Art)
FIG. 1 is a conceptual illustration showing product suspension particle separation utilizing electrostatic methods, as practiced in the prior art.
Figure 2:
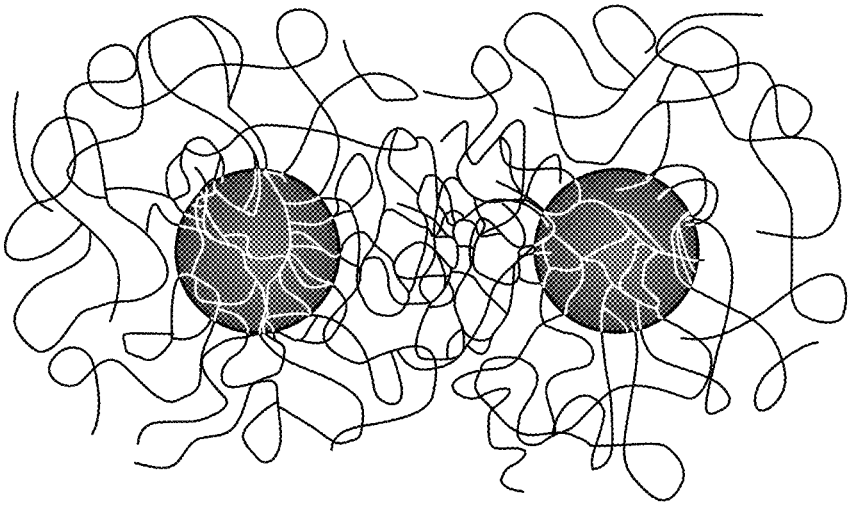
FIG. 2 (Prior Art)
FIG. 2 is a conceptual illustration showing product suspension particle separation utilizing steric methods, as practiced in the prior art.

The following detailed description is merely exemplary in nature and is not intended to limit the invention or the application and uses of the invention. As used herein, the word "exemplary" means "serving as an example, instance, or illustration." Thus, any embodiment described herein as "exemplary" is not necessarily to be construed as preferred or advantageous over other embodiments. Furthermore, as used herein, numerical ordinals such as "first," "second," "third," etc., such as first, second, and third components, simply denote different singles of a plurality unless specifically defined by language in the appended claims. All of the embodiments and implementations described herein are exemplary embodiments provided to enable persons skilled in the art to make or use the invention and not to limit the scope of the invention which is defined by the claims. Furthermore, there is no intention to be bound by any expressed or implied theory presented in the preceding technical field, background, brief summary, or the following detailed description.

Disclosed herein are embodiments of methods and apparatus for producing nanometer scale particles utilizing an electrosterically stabilized slurry in a media mill. The disclosed embodiments makes use of electrosteric (electrostatic and steric) stabilization of ultra-fine (sub-micron) particles in a wet milling process using electrosteric dispersants. Electrosteric dispersants are polymers that are capable of stabilizing product particle suspensions electrostatically as well as sterically. With electrosteric dispersants, there is reduced use of the dispersant, the amount of dispersant used need to be controlled to an exacting standard, and agglomeration of the particles is efficiently avoided. This enables an increased milling efficiency and a reduced energy consumption for the wet milling process because the viscosity of the suspension remains low, and further there is a reduced probability of mill screen blockage because of the reduced probability of agglomeration.

The nanometer scale particles in accordance with the present disclosure may represent a variety of substances useful in a variety of industries. For example, particles that may be milled as described herein may include inorganic and organic solids, minerals, ores, silica, diatomaceous earth, clays, organic and inorganic pigments, pharmaceutical materials, carbon black, paint additives, pigments, photographic materials, cosmetics, chemicals, metal powders useful as catalysts and supports, stationary phase particles useful in analytical and preparative chromatographic separations of chemical compounds, powdered toners, therapeutic and diagnostic imaging agents, medicinally active agents, medicaments, plant and herbal extracts, drugs, pro-drugs, drug formulations, and the like.

In accordance with the methods of the present disclosure, nanoscale particles have been demonstrated having ($D_{90}$) mean particle sizes below one micron, for example below 800 nanometers (nm), or below 500 nm. As set forth in the examples below, using input particles having a $D_{90}$ mean particle size of about 5 microns, product particles have been prepared having $D_{10}$ mean particle sizes of about 100 nm to about 200 nm, $D_{50}$ mean particle sizes of about 150 to about 250 nm, and $D_{90}$ mean particle sizes of about 250 nm to about 350 nm. It is expected that particles within the aforementioned size range, or anywhere between the aforementioned size range and an input size of ($D_{90}$) about 100 microns or less (such as about 50 microns or less, or about 30 microns or less, or about 10 microns or less), will find application in almost any industrial or commercial application currently practiced. Greater detail regarding the wet media milling process, along with the electrosteric dispersants used in the milling process, is provided below. In particular, two embodiments of a mill are disclosed below in connection with FIG. 3A (vertical wet media mill) and FIG. 3B (horizontal media mill).

Wet Media Milling

In a wet milling process, repeated collisions of milling media with a solid particle material being milled, i.e., the milled substrate, result in repeated fracture of the substrate and concomitant substrate particle size reduction. When a wet media milling process is used to reduce the size of particles of the substrate, the process is usually carried out in a mill including a milling chamber containing milling media, the solid material or substrate that is to be milled, and a liquid carrier in which the media and substrate are suspended. The contents of the milling chamber are stirred or agitated with an agitator that transfers mechanical work and energy to the milling media. The accelerated milling media collide with the substrate in energetic collisions that may crush, chip, fracture, or otherwise reduce the size of the solid substrate material and lead to an overall reduction in substrate particle size, and an overall reduction in substrate average or mean particle size distribution. Examples of suitable wet milling systems include ball mills, planetary ball mills, circulating stirred media mills, basket stirred media mills, ultrasonic media mills, and the like.

Milling media are generally selected from a variety of dense and hard materials, such as sand, steel, silicon carbide, ceramics, zirconium silicate, zirconium and yttrium oxide (e.g., yttria stabilized zirconia), glass, alumina, titanium, and certain polymers such as crosslinked polystyrene and methyl methacrylate. Media geometries may vary depending on the application, although spherical ball-shapes or cylindrical beads are commonly used. In some embodiments, milling media may be of various sizes and size distributions that include large milling media particles and smaller milling media particles. Suitable liquid carriers for the milling media and substrate include water, aqueous salt solutions, buffered aqueous solutions, organic solvents such as ethanol, methanol, butanol, hexane, hydrocarbons, kerosene, PEG-containing water, glycol, toluene, petroleum-based solvents, mixtures of aromatic solvents such as xylenes and toluene, heptane, and the like. Typically, the solvent will be selected based upon the substrate (product) particles.

Wet media mills useful for reducing the particle size of a solid substrate may operate in a batchwise mode or in a continuous or semi-continuous mode. Wet media mills operating in a continuous mode may incorporate a separator or screen for retaining milling media together with relatively large particles of the solid substrate being milled in the milling zone or milling chamber of the mill while allowing smaller particles of the substrate being milled, i.e., product substrate particles, to pass out of the milling chamber in either a recirculation or discrete pass mode. Recirculation may be in the form of a slurry, suspension, dispersion, or colloid of the substrate suspended in a fluid carrier phase that moves from the milling chamber into a holding vessel and thence back to the milling chamber, for example with the aid of a pump. A separator or screen may be located at the outlet port of the milling chamber, including for example rotating gap separators, screens, sieves, centrifugally-assisted screens, and similar devices to physically restrict passage of milling media from the mill. Retention of milling media occurs because the dimensions of the milling media are larger than the dimensions of the openings through which the reduced size substrate particles may pass.

Figure 3A:
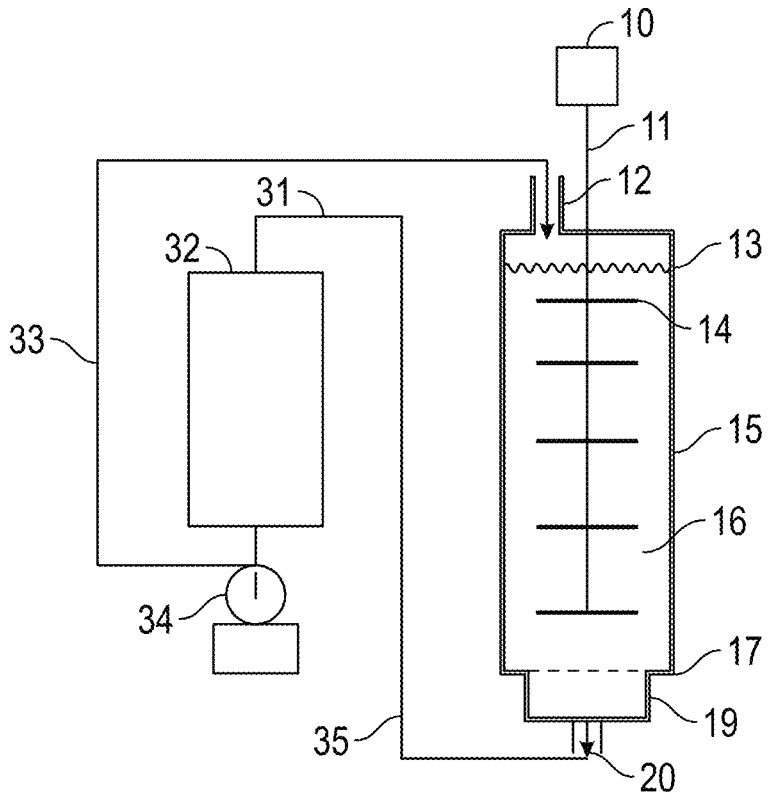
FIGS. 3A and 3B are schematic drawings of a wet media mill useful in milling particles in a continuous process in accordance with some embodiments of the present disclosure.

FIG. 3A depicts an exemplary vertical wet media mill 15 configured for use in accordance with some embodiments of the present disclosure, wherein the reference numerals correspond with the following illustrated features:

10: motor
11: shaft
12: entry port
13: charging level
14: agitator
15: media mill
16: milling chamber
17: secondary screen
19: exit screen
20: exit port
31: inlet port
32: holding tank
33: piping system
34: pump
35: piping system The exemplary wet media mill 15 is now described in accordance with its usual operation. In an embodiment, a milling media (not shown) and a fluid carrier that contains an electrosteric dispersant may be added to milling chamber 16 of media mill 15 through entry port 12. (The electrosteric dispersant is described in greater detail, below.) During this charging of the media mill 15, agitator 14 may optionally be in operation, and exit port 20 may be open to allow fluid carrier to exit from the media mill 15, or it may be closed to contain the fluid carrier. Optionally, a secondary larger screen 17 including openings through which the milling media may pass may be provided in the media mill 15.

The milling chamber 16 may then be charged with the solid substrate to be milled and optionally additional fluid carrier (optionally including additional electrosteric dispersant). Additionally, the milling chamber 16 may further be charged with a defoaming agent that prevents bubble formation during the milling process, as known in the art. In embodiments, once all of the fluid carrier and the substrate has been added, the slurry may have a solids content from about 5 wt.-% to about 40 wt.-%, such as from about 10 wt.-% to about 40 wt.-%, or about 15 wt.-% to about 40 wt.-%, or about 20 wt.-% to about 40 wt.-%. The exit port 20 of the milling chamber 16 may then be closed and the media mill 15 may be charged to a level 13. Fluid carrier may be transferred using a piping system 35 with the aid of a pump 34 to a holding tank 32 via inlet port 31. The fluid carrier may be pumped from the holding tank 32 via the piping system 33 back to the inlet port 12 of the media mill 15.

The contents of the media mill 15 are agitated or stirred, preferably at a high speed or with high acceleration and deceleration, by agitator 14 that is driven by motor 10 and coupled with shaft 11. The time period of agitation to produce a product in accordance with the present disclosure may range, for example, from about 10 minutes to about 6,000 minutes or more, such as about 10 minutes to about 3,000 minutes, or about 10 minutes to about 1,000 minutes. Fluid carrier is continuously recirculated from the milling chamber 16 to the holding tank 32. This recirculation may be continued until a minimum or a desired substrate particle size is obtained, for example within the mean particle size ranges described above. During this process, additional electrosteric dispersant may be added, as required.

At the end of the process, the residual product particles of milled solid substrate remaining in the media may be transferred to the holding tank 32 as a dispersion in the fluid carrier, optionally under pressure or by means of pump 24 from the milling chamber 16. Essentially all milling media remain in the milling chamber 16, and the product substrate particles are isolated substantially free of milling media as a dispersion in the fluid carrier. The product substrate particles produced in accordance with the present disclosure may have a ($D_{90}$) particle size of less than about one micron, such as less than about 800 nm, or less than about 500 nm. The fluid carrier may be removed by drying or baking, as is known in the art. The electrosteric dispersant may remain with the milled product after drying in some embodiments, whereas in other embodiments the electrosteric dispersant may be removed, for example by baking in a kiln. Removal of the electrosteric dispersant will depend on final product requirements and intended application.

Figure 3B:
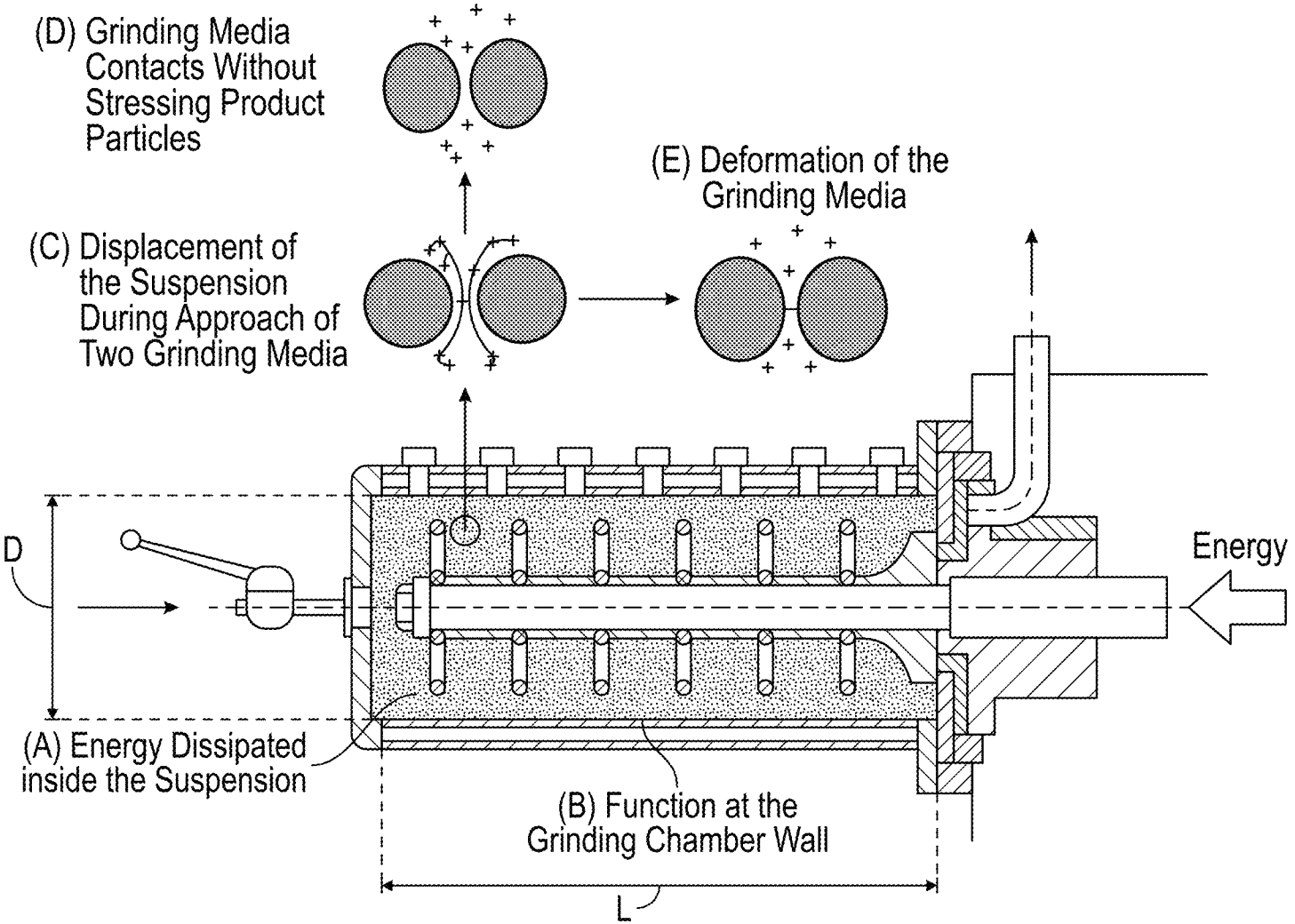

FIG. 3B presents an alternative embodiment of a stirred media mill, namely a horizontal media mill. Many of the physical components of the embodiment of FIG. 3B are similar to that of FIG. 3A, as both embodiments accomplish the same function. In FIG. 3B, however, attention is drawn to the particular functions that occur in each area of the mill, with reference to illustrated functions (A) through (E). As illustrated, at function (A), energy that is input to the mill through the shaft is dissipated inside the suspension. At function (B), friction occurs in the suspension where the agitator is near the chamber wall. At function (C), displacement occurs within the suspension during the approach of two or more pieces of grinding media towards one another. At function (D), the grinding media contact one another without causing stress to the suspended particles. Further, at function (E), the grinding media may be deformed temporarily after the contact.

Electrosteric Dispersants

Figure 4:
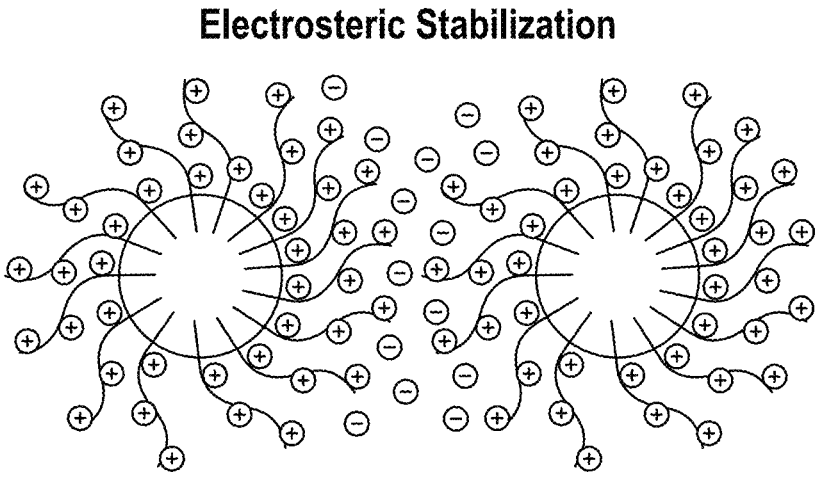
FIG. 4 is a conceptual illustration showing product suspension particle separation utilizing electrosteric methods in accordance with some embodiments of the present disclosure.

Greater detail is now provided regarding the electrosteric dispersants utilized in the wet media milling processes of the present disclosure. The electrosteric dispersants provide electrosteric stabilization to the product particles. Electrosteric stabilization is a combination of electrostatic and steric stabilization. With reference to FIG. 4, electrosteric stabilization involves adsorbing charged polymers (polyelectrolytes) on the surface of the colloidal product particles. The surface of a particle typically is composed of negative as well as positive sites. For instance, such charged sites may include functional groups including but not limited to $OH^-$, $H^+$, $O_2^-$, and $O^-$, among others. The relative concentration of each charge depends on a number of factors including the nature of particle, the oxidation state of the particle, and the pH of the system.

Polyelectrolytes have associated with them an overall electrical character (i.e., positive or negative). Polyelectrolytes adsorb strongly to the surface of particles by attaching themselves to oppositely charged sites on the surface of particles. Not all of the ionic sites on each polyelectrolyte, however, are used during the adsorption process. While some of the ionic sites are used to adsorb the polyelectrolyte to the surface of the particle, others of the ionic sites are in the part of the polymer that trails freely in the liquid medium. The combined like charges associated with the particle surface and polymer chains in solution give each particle an overall negative or positive charge for the particle-polymer composition. Each polymer-coated particle may repel the like charges associated with other polymer-coated particles because such particles experience an electronic repulsion. This electronic repulsion, in combination with the steric effect of the polymer, disperses the product suspension. Moreover, as both electrostatic and steric separation is achieved, particle separation is significantly stronger than either electrostatic or steric separation alone, resulting is less dispersant required, and less tight control requirements over the amount of dispersant used in the milling process.

Polyelectrolytes suitable for use in accordance with the present disclosure as electrosteric dispersants include functional polymers that have a number-average molecular mass of at least about 500 g/mol, for example at least about 1,000 g/mol, such as at least about 2,000 g/mol. In some embodiments, the functional polymers may have a number-average molecular mass as high as about 5 million, or even 50 million g/mol. Typically, though, the number-average molecular mass will be less than about 500,000 g/mol, such as less than about 100,000 g/mol, or less than about 50,000 g/mol, or less than about 25,000 g/mol. In particular, the polyelectrolyte dispersant may be chosen from polymers and copolymers having electrically-charged functional groups or inorganic affinic groups, alkylammonium salts of polymers and copolymers, polymers and copolymers having acidic groups, functionalized comb copolymers and block copolymers, modified acrylate block copolymers, modified polyurethanes, modified and/or salified polyamines, phosphoric polyesters, polyethoxylates, polymers and copolymers having fatty acid radicals, modified polyacrylates such as transesterified polyacrylates, modified polyesters such as acid-functional polyesters, polyphosphates, and mixtures thereof. Suitable electrosteric dispersants are sold under the trade names: Disperbyk-199 and Disperbyk-2010 (BYK GmbH, Wesel, DE); and Flexisperse 225 and Flexisperse 300 (ICT, Cartersville, Ga., US), as non-limiting examples. In embodiments, the product suspension in the wet media mill may have an electrosteric dispersant content from about 2 wt.-% to about 20 wt.-%, such as from about 2 wt.-% to about 15 wt.-%, or about 5 wt.-% to about 15 wt.-%, based on the weight of the solid particles.

Milling Method

Figure 5:
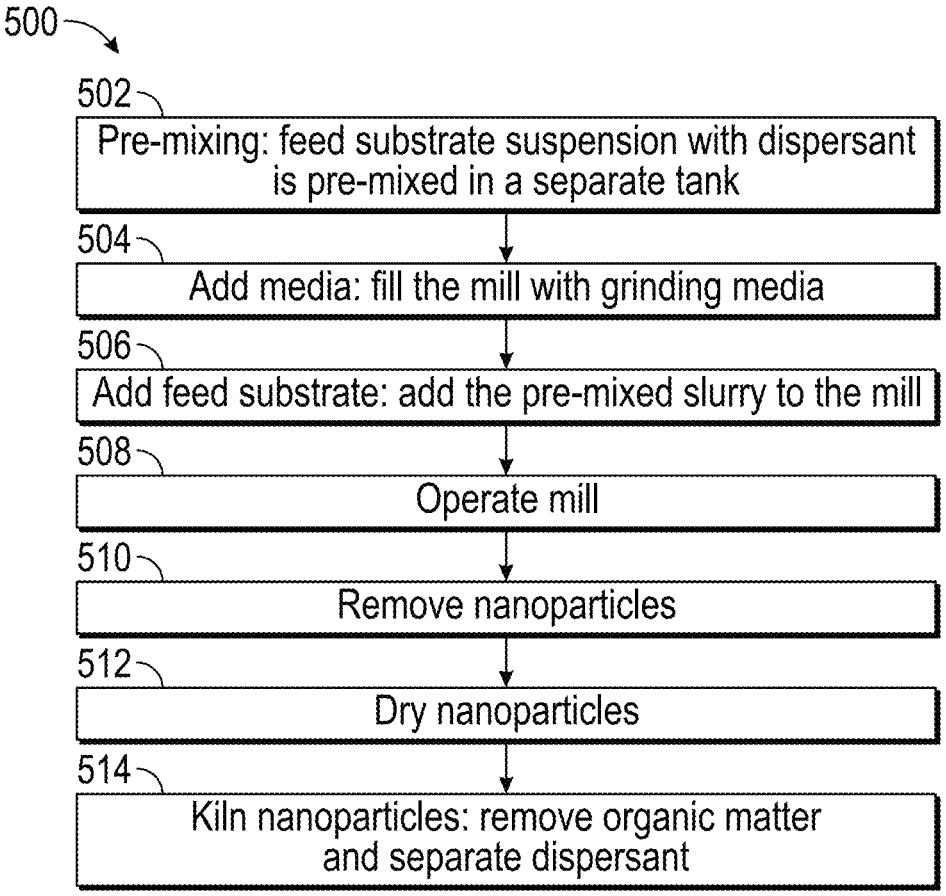
FIG. 5 is a flowchart illustrating a method for wet media milling in accordance with some embodiments of the present disclosure.
Figure 6A:
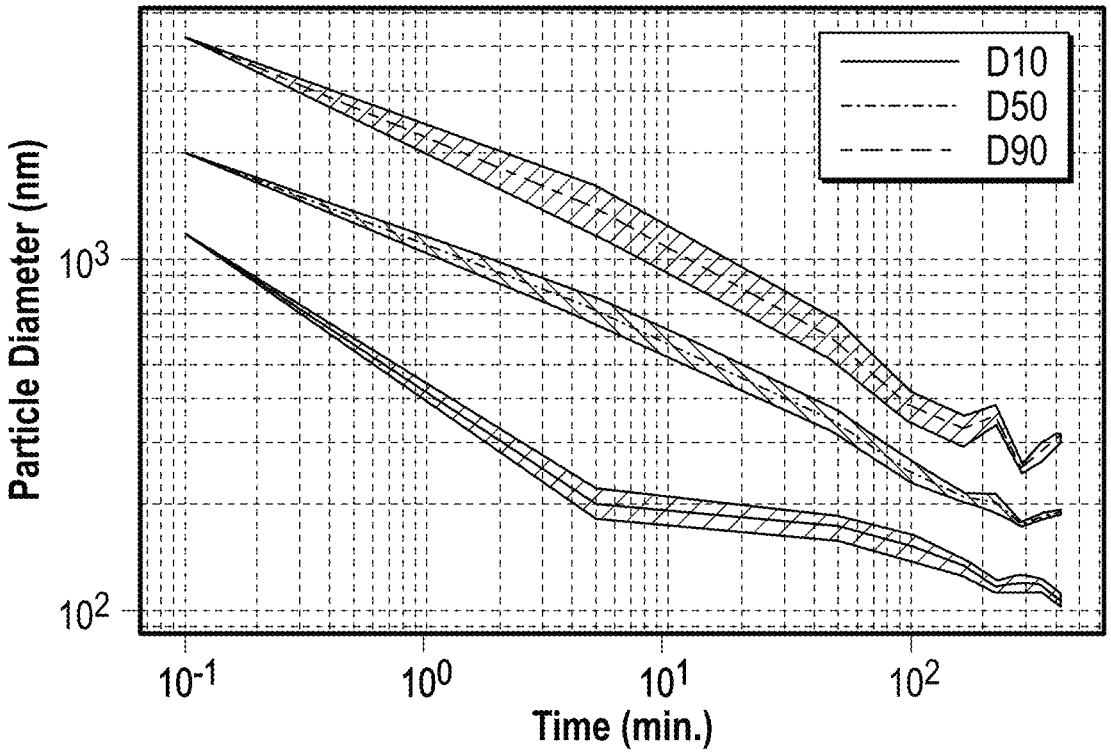
FIGS. 6A-6E are graphs illustrating average particle size diameters for particles produced in accordance with some examples of the present disclosure.
Figure 6B:
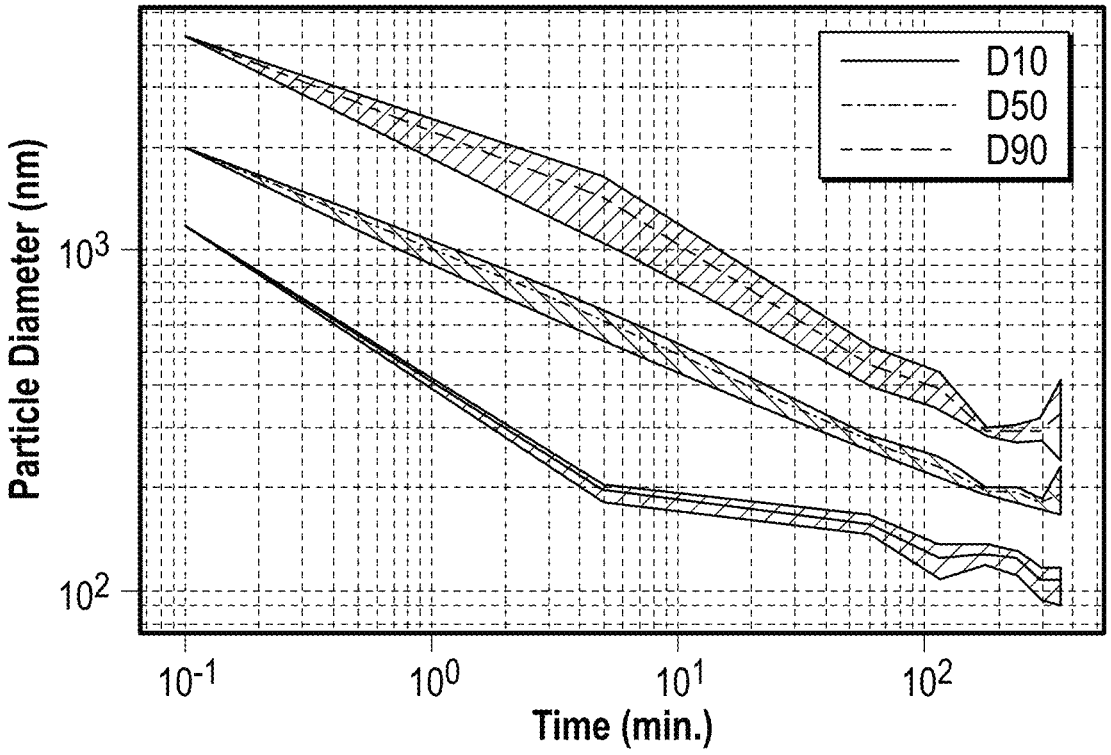
Figure 6C:
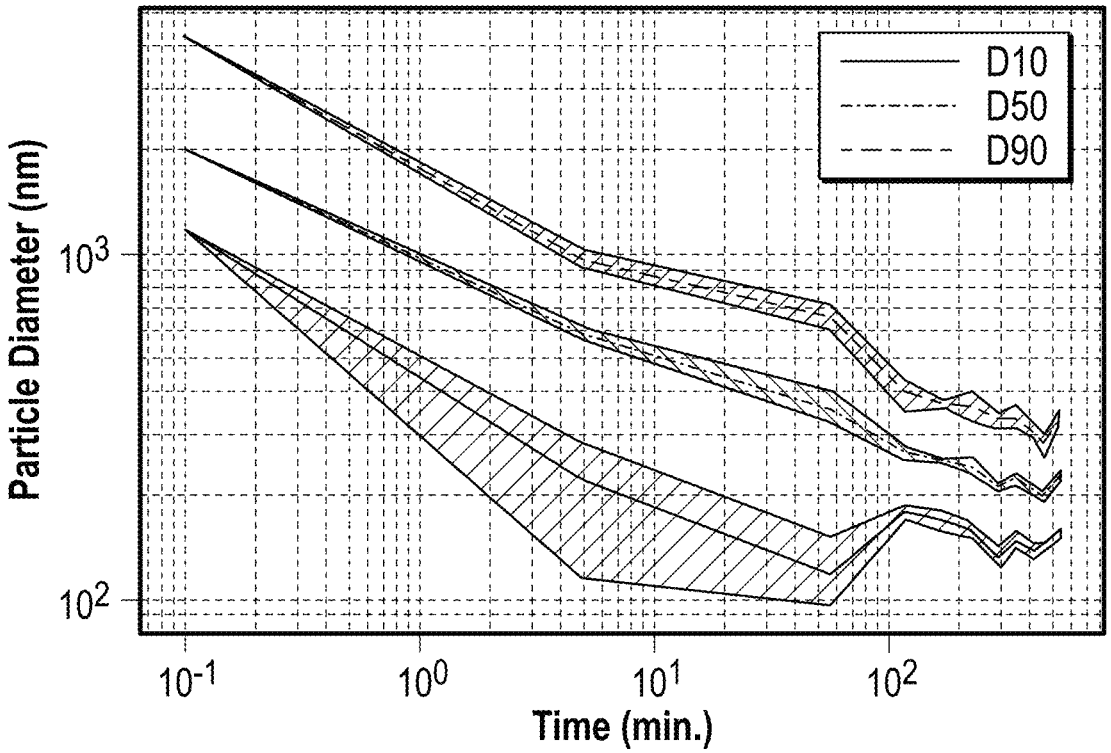
Figure 6D:
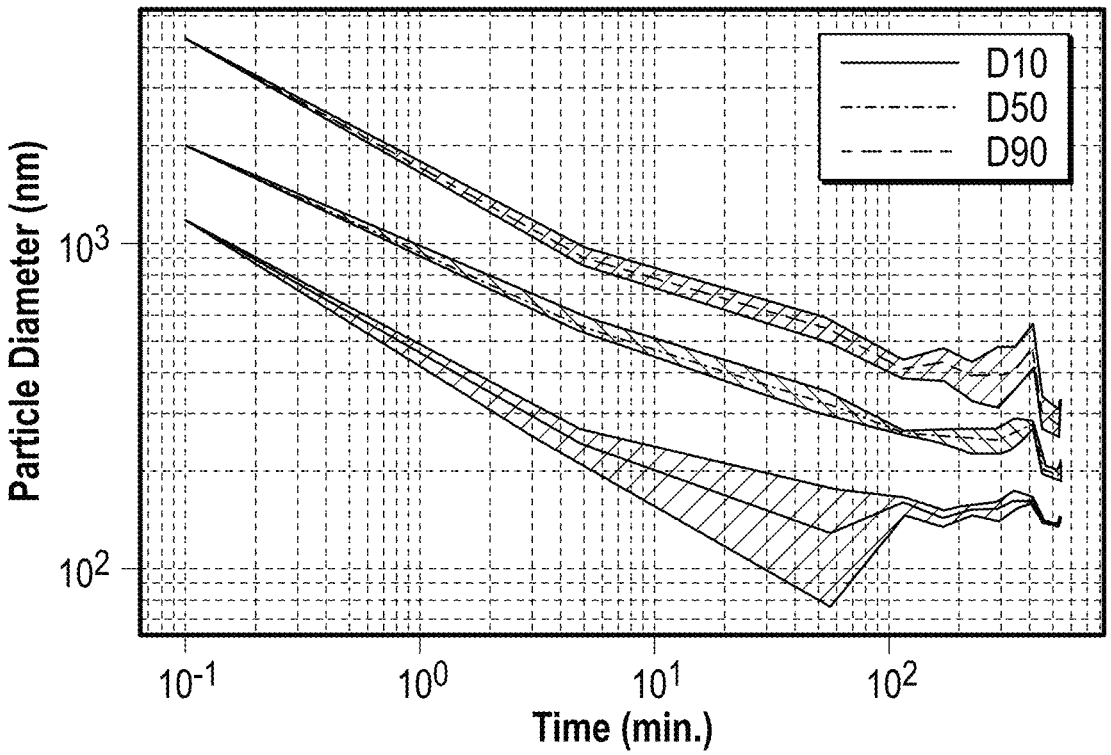
Figure 6E:
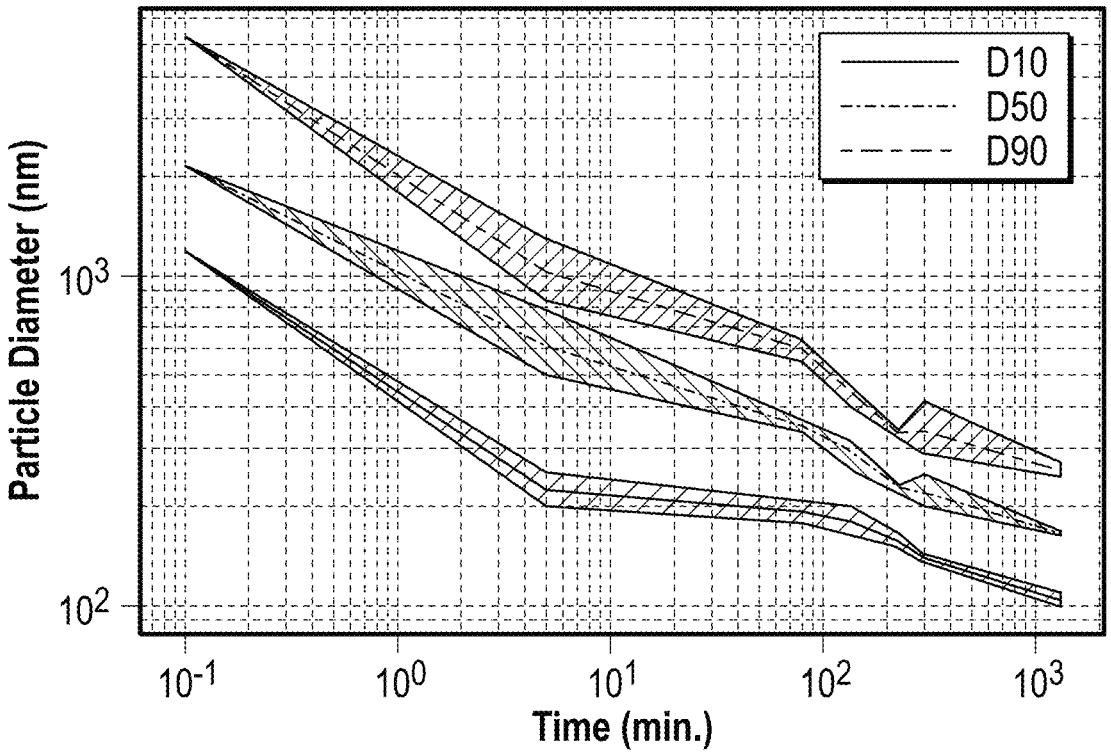

Referring to FIG. 5, illustrated is a flowchart for a method 500 for producing nanometer scale particles. The method 500 includes step 502 of pre-mixing, which is when the feed substrate suspension is pre-mixed with dispersant in a separate tank. The feed substrate suspension includes a liquid carrier medium and feed substrate particles. The liquid carrier medium may include water or an organic solvent. The feed substrate particles may include organic or inorganic solids, glass, graphene, metals, minerals, ores, silica, diatomaceous earth, clays, organic and inorganic pigments, pharmaceutical materials, or carbon black. The feed substrate particles may be present in the feed substrate suspension in an amount of about 5% to about 70% by weight of the feed substrate suspension, or about 5% to about 40% by weight. The electrosteric dispersant may be added in an amount of about 2% to about 20% by weight of the feed substrate particles. The electrosteric dispersant includes a polyelectrolyte. The polyelectrolyte may include a polymer or copolymer having electrically-charged functional groups or inorganic affinic groups.

The method 500 further includes a step 504 of adding milling/grinding media to the mill, that is, the mill is filled with an appropriate amount of milling/grinding media. Milling media are generally selected from a variety of dense and hard materials, such as sand, steel, silicon carbide, ceramics, zirconium silicate, zirconium and yttrium oxide (e.g., yttria stabilized zirconia), glass, alumina, titanium, and certain polymers such as crosslinked polystyrene and methyl methacrylate. Media geometries may vary depending on the application, although spherical ball-shapes or cylindrical beads are commonly used. In some embodiments, milling media may be of various sizes and size distributions that include large milling media particles and smaller milling media particles.

The method 500 further includes a step 506 of adding to a media mill the pre-mixed feed substrate suspension from step 502. The feed suspension may be added in a batch or continuous process. A defoaming agent may also optionally be added. Still further, the method 500 includes step 508 of operating the media mill for a period of time to comminute the feed substrate particles, thereby forming nanometer scale particles having a ($D_{90}$) particle size of less than about one micron, or less than about 800 nm, or less than about 500 nm, or less than about 400 nm. The period of time may be from about 10 minutes to about 6,000 minutes, or from about 10 minutes to about 3,000 minutes, or from about 10 minutes to about 1,000 minutes. Additional electrosteric dispersant may be added during the period of time that the media mill is operating.

Additionally, the method 500 includes step 510 of recirculating for further grinding the nanometer scale particles from the media mill. Part of this step may further include removing the nanometer scale particles from the media mill may include separating the nanometer scale particles from the milling media. Optionally, the method 500 may include a step 512 of drying the nanometers scale particles after removing the nanometer scale particles from the media mill. Optionally, the method 500 may include a step 514 of, using a kiln, separating the electrosteric dispersant from the nanometer scale particles and removing any organic matter after removing the nanometer scale particles from the media mill. It should be appreciated that various steps in method 500 may be repeated one or more times throughout the operation of the method.

ILLUSTRATIVE EXAMPLES

The present disclosure is now illustrated by the following non-limiting examples. It should be noted that various changes and modifications may be applied to the following examples and processes without departing from the scope of this invention, which is defined in the appended claims. Therefore, it should be noted that the following examples should be interpreted as illustrative only and not limiting in any sense.

Five different example particle suspensions were prepared including a water (as the liquid medium), crystalline silica/quartz particles or diatomaceous earth particles (as the solid substrate), a defoaming agent, and various types and amounts of polyelectrolyte (as the electrosteric dispersant). The composition of each example slurry is presented below in TABLE 1.

TABLE 1

| | [4]Example 1 | [4]Example 2 | Example 3 | Example 4 | Example 5 |
|---|---|---|---|---|---|
| Feed | Crystalline Silica/Quartz | Crystalline Silica/Quartz | Crystalline Silica/Quartz | Crystalline Silica/Quartz | Diatomaceous Earth |
| Feed Size ($D_{90}$)[1] | 5 microns | 5 microns | 5 microns | 5 microns | 50 microns |
| Solids Concentration | 30 wt.-% | 35 wt.-% | 37.5 wt.-% | 35 wt.-% | 20 wt.-% |
| Dispersant | Flexisperse[2] 225 | Flexisperse 225 | Disperbyk[3] 199 | Disperbyk 199 | Disperbyk 199 |
| Dispersant Concentration (by weight of solids) | 5% | 5% | 5% | 5% | 10% |
| Grinding Media Volume (% of Mill Volume) | 80% | 80% | 67% | 67% | 67% |
| Grinding Media Size | 0.1-0.2 mm | 0.1-0.2 mm | 0.1-0.2 mm | 0.1-0.2 mm | 0.1-0.2 mm |
| Mill Tip Speed | 14.7 m/s | 14.7 m/s | 17.6 m/s | 17.6 m/s | 8.8 m/s |

[1]Feed size measured using a laser particle analyzer (Microtrac S3500; available from Microtrac Retsch GmbH (Haan, Germany))

[2]Flexisperse 225 available from Innovative Chemical Technologies (Cartersville, GA, USA)

[3]Disperbyk 199 available from BYK-Chemie GmbH (Wesel, Germany)

[4]No defoaming agent used

Each of the example particle suspensions was placed into a circulating stirred media mill (VMA Dispermat SL12, available from VMA-GETZMANN GmbH (Reichshof, Germany)) that also included yttria stabilized zirconia (YSZ) beads as the grinding media. Each example was subjected to wet media milling in the stirred media mill for a time period ranging from about 150 minutes to about 1,000 minutes. After the milling was completed, the product particles were measured for $D_{10}$, $D_{50}$, and $D_{90}$ mean particle size using a nanoparticle analyzer (Anton-Paar Litesizer 500 (available from Anton Paar GmbH, Graz, Austria)). The mean particle sizes, as a function of milling time, for each of Examples 1-5, are presented in FIGS. 6A-6E, respectively. As shown in those Figures, methods in accordance with the present disclosure are readily able to achieve $D_{10}$ mean particle sizes of about 100 nm to about 200 nm, $D_{50}$ mean particle sizes of about 150 to about 250 nm, and $D_{90}$ mean particle sizes of about 250 nm to about 350 nm.

As such, the present disclosure has provided embodiments of methods and apparatus for producing nanometer scale particles utilizing an electrosterically stabilized slurry in a media mill. The methods and apparatus beneficially maintain particle separation as the particle size decreases below about 1 micron to avoid agglomeration and mill screen blockage. Moreover, the methods and apparatus are beneficially suitable for industrial scale manufacturing to the extent that tight control of any additives is not required to prevent product suspension flocculation or steep increases in viscosity.

While at least one exemplary embodiment has been presented in the foregoing detailed description, it should be appreciated that a vast number of variations exist. It should also be appreciated that the exemplary embodiments are only examples, and are not intended to limit the scope, applicability, or configuration of the invention in any way. Rather, the foregoing detailed description will provide those skilled in the art with a convenient road map for implementing an exemplary embodiment of the inventive methods and apparatus. It is understood that various changes may be made in the function and arrangement of elements described in an exemplary embodiment without departing from the scope of the invention as set forth in the appended claims.

What is claimed is:

1. A method for producing nanometer scale particles comprising:

providing a media mill;

adding to the media mill a feed substrate suspension, wherein the feed substrate suspension comprises a liquid carrier medium and feed substrate particles, wherein the feed substrate particles comprise organic solids, glass, graphene, metals, ores, silica, diatomaceous earth, clays, organic pigments, pharmaceutical materials, or carbon black;

adding to the feed substrate suspension in the media mill an electrosteric dispersant to separate the feed substrate particles in the feed substrate suspension in order to improve spacing of the feed substrate particles, wherein the electrosteric dispersant comprises a polyelectrolyte;

operating the media mill for a period of time to comminute the feed substrate particles, thereby forming nanometer scale particles having a ($D_{90}$) particle size of less than one micron; and recirculating for further grinding the nanometer scale particles from the media mill.

2. The method of claim 1, wherein the liquid carrier medium comprises water or an organic solvent.

3. The method of claim 1, wherein the feed substrate particles comprise glass, silica, or diatomaceous earth.

4. The method of claim 1, wherein the feed substrate particles are present in the feed substrate suspension in an amount of 20% to 70% by weight of the feed substrate suspension.

5. The method of claim 4, wherein the feed substrate particles are present in the feed substrate suspension in an amount of 20% to 40% by weight of the feed substrate suspension.

6. The method of claim 1, wherein the polyelectrolyte comprises a polymer or copolymer having electrically-charged functional groups or inorganic affinic groups.

7. The method of claim 1, wherein the period of time is from 10 minutes to 6,000 minutes.

8. The method of claim 1, wherein the nanometer scale particles have a ($D_{90}$) particle size of less than 500 nm.

9. The method of claim 1, wherein the media mill comprises a milling media, and wherein recirculating for further grinding the nanometer scale particles from the media mill further comprises separating the nanometer scale particles from the milling media.

10. The method of claim 1, further comprising drying the nanometers scale particles after recirculating for further grinding the nanometer scale particles from the media mill.

11. The method of claim 1, further comprising separating the electrosteric dispersant from the nanometer scale particles after recirculating for further grinding the nanometer scale particles from the media mill.

12. The method of claim 1, further comprising adding to the feed substrate suspension in the media mill a defoaming agent.

13. The method of claim 1, wherein the electrosteric dispersant is added in an amount of 2% to 20% by weight of the feed substrate particles.

14. The method of claim 1, further comprising adding additional electrosteric dispersant during the period of time that the media mill is operating.

15. A media mill apparatus configured for producing nanometer scale particles comprising:

a milling chamber;

an agitator extending into the milling chamber;

a milling media disposed within the milling chamber;

a feed substrate suspension comprising a liquid carrier medium and feed substrate particles, and disposed within the milling chamber and interspersed with the milling media wherein the feed substrate particles comprise organic solids, glass, graphene, metals, ores, silica, diatomaceous earth, clays, organic pigments, pharmaceutical materials, or carbon black; and an electrosteric dispersant to separate the feed substrate particles in the feed substrate suspension in order to improve spacing of the feed substrate particles comprising a polyelectrolyte mixed within the feed substrate suspension, wherein the agitator is configured to apply mechanical work to the milling media for a period of time, thereby causing the milling media to comminute the feed substrate particles to form nanometer scale particles having a ($D_{90}$) particle size of less than one micron.

16. The media mill apparatus of claim 15, wherein the milling chamber further comprises a screen, wherein the screen is sized to permit passage of the nanometer scale particles but not the milling media.

17. The media mill apparatus of claim 15, wherein the milling media comprises one or more of sand, steel, silicon carbide, ceramics, zirconium silicate, zirconium and yttrium oxide, glass, alumina, titanium, crosslinked polystyrene, and methyl methacrylate.

18. The media mill apparatus of claim 15, wherein the milling media are provided in the shape of one or more of balls, beads, and cylinders.

19. The media mill apparatus of claim 15, wherein the polyelectrolyte comprises a polymer or copolymer having electrically-charged functional groups or inorganic affinic groups.

20. A method for producing nanometer scale particles in a media mill comprising a milling media, the method comprising:

providing a media mill;

adding to the media mill a feed substrate suspension, wherein the feed substrate suspension comprises a liquid carrier medium and feed substrate particles;

adding to the feed substrate suspension in the media mill an electrosteric dispersant to separate the feed substrate particles in the feed substrate suspension in order to improve spacing of the feed substrate particles, wherein the electrosteric dispersant comprises a polyelectrolyte, wherein the polyelectrolyte comprises at least one of: alkylammonium salts of polymers and copolymers, polymers and copolymers having acidic groups, functionalized comb copolymers and block copolymers, modified acrylate block copolymers, modified polyurethanes, modified and/or salified polyamines, phosphoric polyesters, polyethoxylates, polymers and copolymers having fatty acid radicals, modified polyesters polyphosphates, or a mixture thereof;

operating the media mill for a period of time to comminute the feed substrate particles, thereby forming nanometer scale particles having a ($D_{90}$) particle size of less than one micron; and recirculating for further grinding the nanometer scale particles from the media mill.

21. The method of claim 20, wherein the polyelectrolyte comprises a styrene-based co-polymer.

* * * * *